US008151706B2

(12) United States Patent
Scholz et al.

(10) Patent No.: US 8,151,706 B2
(45) Date of Patent: Apr. 10, 2012

(54) APPARATUS WITH ELECTRICAL CRUSH PROTECTOR AND PRINTING PRESS HAVING THE APPARATUS

(75) Inventors: Holger Scholz, Heidelberg (DE); Andreas Weber, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 611 days.

(21) Appl. No.: 12/176,002

(22) Filed: Jul. 18, 2008

(65) Prior Publication Data

US 2009/0022538 A1 Jan. 22, 2009

(30) Foreign Application Priority Data

Jul. 18, 2007 (DE) ..... 10 2007 033 432

(51) Int. Cl.

| | |
|---|---|
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |
| ***G03G 15/32*** | (2006.01) |

(52) U.S. Cl. ..... 101/484; 101/494

(58) Field of Classification Search ..... 101/479, 101/484, 494; 271/217

See application file for complete search history.

(56) References Cited

U.S. PATENT DOCUMENTS

| | | | | |
|---|---|---|---|---|
| 4,186,309 | A | 1/1980 | Gnuechtel | |
| 4,578,757 | A | 3/1986 | Stark | |
| 4,951,567 | A * | 8/1990 | Rodi et al. | 101/216 |
| 6,135,445 | A * | 10/2000 | Gamperling et al. | 271/220 |
| 6,361,039 | B1 * | 3/2002 | in 't Zandt et al. | 271/159 |
| 2004/0186617 | A1 | 9/2004 | Bantlin et al. | |
| 2008/0119960 | A1 | 5/2008 | Beaulieur et al. | |

FOREIGN PATENT DOCUMENTS

| | | | |
|---|---|---|---|
| DE | 40 38 284 | A1 | 6/1992 |
| DE | 297 21 820 | U1 | 2/1998 |
| DE | 197 42 764 | C1 | 9/1998 |
| DE | 10 2004 002 307 | A1 | 8/2004 |
| EP | 0087196 | A2 | 8/1983 |
| EP | 1086917 | A1 | 3/2001 |
| WO | 9411288 | A1 | 5/1994 |
| WO | 2006018485 | A1 | 2/2006 |

OTHER PUBLICATIONS

German Patent and Trademark Office Search Report, dated Jan. 7, 2008.

* cited by examiner

*Primary Examiner* — Judy Nguyen
*Assistant Examiner* — Blake A Tankersley
(74) *Attorney, Agent, or Firm* — Laurence A. Greenberg; Werner H. Stemer; Ralph E. Locher

(57) ABSTRACT

An apparatus for safely operating at least two components which are movable relative to one another in a machine for processing printing materials, includes drive motors each driving a respective one of the movable components. At least one control computer detects movement of the movable components. The control computer is set up in such a way that, if a spacing is reduced between the movable components, at least that movable component, which is the cause for the reduction in the spacing between the movable components, is brought to a standstill. A printing press having the apparatus is also provided.

8 Claims, 4 Drawing Sheets

APPARATUS WITH ELECTRICAL CRUSH PROTECTOR AND PRINTING PRESS HAVING THE APPARATUS

CROSS-REFERENCE TO RELATED APPLICATION

This application claims the priority, under 35 U.S.C. §119, of German Patent Application DE 10 2007 033 432.1, filed Jul. 18, 2007; the prior application is herewith incorporated by reference in its entirety.

BACKGROUND OF THE INVENTION

Field of the Invention

The present invention relates to an apparatus for the safe operation of at least two components which can be moved relative to one another and are each driven by a respective drive motor in a machine that processes printing materials, and includes a control computer for detecting movement of the movable components. A printing press having the apparatus is also provided.

Sheet-fed rotary printing presses have a multiplicity of movable components which, in the unprotected form, can represent a risk source for the operating staff. The movable components are present as components with a rotationally movable configuration in the form of cylinders in printing units and as components which can be displaced in parallel in a feeder or delivery of the printing press, where a main stack and an auxiliary stack are moved parallel to one another. There is a risk in the case of the rotating cylinders and components which can be displaced in parallel of the operating staff suffering injuries due to limbs being crushed. There is an increased injury potential, in particular, in the feeder and delivery region which has to be freely accessible for changing the stack or for removing sample or proof sheets, such as on the delivery. A series of approaches are therefore known for attaching safety devices to feeders and deliveries of sheet-fed rotary printing presses. Those safety devices limit the risk of injury to a minimum. One possibility includes monitoring the access of persons to dangerous regions, such as in the feeder or delivery. An apparatus of that type is known from German Patent DE 197 42 764 C1, corresponding to European Patent EP 09 05 075 B1. In that case, the entire access cross section of the dangerous region is monitored for the entry of persons. That takes place through the use of a light barrier which reliably detects the entering person. As soon as a person enters the region, the printing press is immediately brought to a standstill. However, the approach with access monitoring of the dangerous region through a light barrier has the disadvantage in principle that the complete machine is switched off even if the entry is not yet dangerous for the operator, as can be the case, for example, during the removal of samples or proofs. However, switching off of the machine in that way leads to operating downtime and therefore to production losses.

German Published, Non-Prosecuted Patent Application DE 10 2004 002 307 A1, corresponding to U.S. Patent Application Publication No. US 2004/0186617 A1, has disclosed a method for synchronizing the main stack and the auxiliary stack in the feeder or delivery of a machine which processes printing materials. In that method, the auxiliary stack controller receives a start signal for moving the auxiliary stack from the main stack controller or a further higher-order machine controller. The start signal at the same time triggers a movement of the main stack. In that way, a synchronous movement of the auxiliary stack and main stack is achieved in the feeder or delivery. However, that control method does not ensure that, in the case of a malfunction of the controller, no dangerous operating states will occur and thus, for example, limbs of persons can be crushed between the main stack and the auxiliary stack.

SUMMARY OF THE INVENTION

It is accordingly an object of the present invention to provide an apparatus with an electric crush protector and a printing press having the apparatus, which overcome the hereinafore-mentioned disadvantages of the heretofore-known devices of this general type and which, in the case of movable components in printing presses, ensure safe operation and at the same time a maximum amount of available operating time of the machine, so that unnecessary downtime can be avoided.

With the foregoing and other objects in view there is provided, in accordance with the invention, an apparatus for safely operating at least two components movable relative to one another in a machine processing printing materials. The apparatus comprises drive motors each driving a respective one of the movable components. At least one control computer detects movement of the movable components. The at least one control computer, upon a reduction in a spacing between the movable components, brings to a standstill at least one of the movable components causing the reduction in the spacing between the movable components.

The apparatus according to the invention can be used in principle in all machines which have components that can be moved relative to one another and are freely accessible for the operating staff, with the result that there is a corresponding risk potential. In particular, the apparatus according to the invention is suitable for ensuring safe operation of sheet-fed offset rotary printing presses which have a multiplicity of components that can be moved relative to one another, in particular in the region of the feeder and delivery. In this case, the at least two components which can be moved relative to one another are driven in each case by a dedicated electric drive motor. As a result, there is only an electric coupling between the components which can be moved relative to one another, through the actuation of the drive motors, but there is no mechanical connection, as exists, for example, in the case of two movable components which are connected through the use of a gearwheel train. The gearwheel train affords the advantage in principle that the components which can be moved relative to one another are fixed in a relative position with respect to one another by the gearwheels, with the result that the two components cannot move toward one another and crush limbs of operators. In the case of components which can be moved relative to one another and are only coupled electrically by a control computer, that mechanical safety does not exist, so that there is the danger of collision and therefore a risk for the operating staff in the case of control errors or if the electric drive motors fail. However, the electric coupling ensures lower mechanical complexity and makes more flexible operation possible, since the coupling can be canceled simply. The movements of the components which can be moved relative to one another are additionally detected by a control computer, with the result that dangerous movements are known to the machine controller. According to the invention, the control computer is set up, moreover, in such a way that, if the spacing is reduced between movable components, at least that movable component is brought to a standstill which is the cause for the reduction in the spacing between the movable components. The control computer therefore permanently monitors the spacing between the movable components and then brings at least that movable component to a standstill which has brought about the reduction in the spacing. This ensures that the spacing between the movable components is not reduced further and can therefore lead to limbs of the operating staff being crushed. Such a reduction in the spacing can always occur when synchronization is lost between the components which can be moved relative to one another. However, if the components which can be moved relative to one another should move further away from one another if synchronization is absent, the control computer does not intervene, since no reduction in the spacing is detected and there is therefore also no direct danger for the operating staff.

In accordance with another feature of the invention, the movable components are two components which can be displaced largely in parallel. These components which can be displaced largely in parallel are found both in the delivery and in the feeder of a sheet-fed offset rotary printing press. There is a main stack carrying board both in the feeder and in the delivery. The main stack carrying board is used in normal operation and carries the main stack both in the feeder and in the delivery. In the feeder, the main stack includes the sheet-shaped printing materials which are fed to the printing press during the printing process. In the delivery, in contrast, the main stack carrying board carries the finished printed sheets. When the main stack in the feeder is exhausted or the main stack in the delivery has reached its maximum, a new stack has to be supplied in the feeder and the finished printed stack has to be removed in the delivery. In order to carry out a nonstop stack change, auxiliary stack carrying boards are present both in the feeder and in the delivery. The auxiliary stack carrying boards are provided to make further sheets available in the feeder for a short time during the stack change and to receive further produced sheets in the delivery. The stack change can then be performed below the auxiliary stack carrier during the limited time period, with the result that the production of the printing press does not have to be interrupted for the stack change. Moreover, a short carrying board which can be closed by way of a flap for sample or proof sheet removal is situated in the delivery of the printing press. The short carrying plate makes it possible to separate sheets for the sample sheet removal instead of on the main stack during running operation. The operating staff can then remove a sheet from this sample sheet remover without risk in order to check the print quality and to feed it, for example, to a color measuring unit. However, there is the danger between the parallel boards in the delivery and feeder that, in the case of a reduction in space between the parallel boards, limbs of the operating staff can be crushed and injured. In order to avoid a crushing occurrence of this type, it is to be ensured as a consequence that the spacing is not reduced, since there is otherwise a risk potential. Precisely this spacing is monitored through the use of the present apparatus according to the invention in such a way that, if the spacing is reduced between the parallel boards, at least that parallel board is brought to a standstill which is moving with a relative speed toward the other parallel board. If, in contrast, the parallel boards should be moving away from one another, the apparatus according to the invention does not need to intervene in the control of the parallel boards. The movable boards do not have to be monitored additionally by light barriers or other sensors, in order to detect the entry of persons, which would then lead to the immediate standstill of the machine. Instead, only the correct operation of the parallel boards is monitored in this case and the board which is the cause is optionally brought to a standstill in the case of deviations.

In accordance with a further feature of the invention, the movable components are two components which can be rotated relative to one another. These components which can be rotated relative to one another are present in sheet-fed rotary printing presses in the form of cylinders in and between the printing units. The transport cylinders which transfer the sheets from one printing unit to the next are situated between the printing units. In most sheet-fed offset printing presses, the transport cylinders and cylinders in the printing units are connected through the use of a gearwheel train, with the result that collisions between the cylinders are prevented in a mechanical way. However, sheet-fed printing presses will also be used in the future, in which there are no longer any mechanical connections between individual cylinders and the cylinders are instead driven at least partially by dedicated electric drive motors. The cylinders which are driven in this way are then no longer secured mechanically against rotation with respect to one another, with the result that, for example, collisions of adjacent cylinders which are driven independently of transfer grippers can occur. The cylinders are covered by a protector during normal operation of the printing press, with the result that there is no risk for the operating staff. However, this protector is dismantled during the maintenance of the printing presses, with the result that there is the risk in this case of crushing between two cylinders which are rotating independently of one another. However, as long as the cylinders rotate slowly in parallel, this risk is low. If the synchronization should fail, however, due to faults in the drive motors or the controller of the cylinders, limbs of the maintenance staff can also be crushed in this case when the machine is open. In order to prevent this, according to the invention, the speeds of the participating cylinders are monitored by the control computer and the cylinders are brought to a standstill in the case of impermissible deviations in speeds from one another. This ensures that limbs of the maintenance staff also cannot be crushed between slowly rotating cylinders during maintenance operation in the case of maintenance procedures.

In accordance with an added feature of the invention, advantageously the drive motors of the movable components are each assigned a respective signal generator and the signal generators are connected to the control computer. The control computer can calculate the differential speed between the movable components through the signal generators in the form of speedometers and, in the case of a positive differential speed, can conclude that the spacing between the movable components is being reduced and there is therefore danger. The speed signal generators can be configured in the form of speed sensors which are either integrated into the electric drive motors themselves or are attached to the movable components as separate sensors.

In accordance with an additional feature of the invention, the control computer has a drive computer and a redundant safety computer. The redundant construction of the control computer increases the safety if the drive computer fails. During normal operation, only the drive computer controls the spacing between the movable components, with the result that the redundant safety computer monitors only and has to intervene in the case of failure or malfunctions of the drive computer. The control computer can be programmed in such a way that, if the drive computer fails, the redundant safety computer brings the printing press safely to a standstill and further operation is possible again only when the control computer is fully functional again. In this case, the control computer, which includes the drive computer and the safety computer, monitors both speed signal generators of the components which can be moved with respect to one another and also actuates both drive motors.

In accordance with yet another feature of the invention, there can also be provision alternatively for each drive motor of the movable components to be assigned in each case one control computer having a drive computer and a safety computer. The control computers communicate with one another through a bus line. In this case, each drive motor has its own control computer which likewise has a redundant construction in each case. The control computers communicate with one another through a safety bus system, such as a safety CAN bus.

In accordance with yet a further feature of the invention, advantageously both movable components are brought to a standstill. This represents an alternative embodiment to the procedure of bringing only that one movable component to a standstill which is responsible for the reduction in the spacing. However, in rotationally movable components, collisions can occur in this case due to the rotational movement between the movable components at the other end of the components, so that simultaneous standstill of both movable components is appropriate in this case.

With the objects of the invention in view, there is concomitantly provided a printing press, comprising the apparatus according to the invention.

Other features which are considered as characteristic for the invention are set forth in the appended claims.

Although the invention is illustrated and described herein as embodied in an apparatus with an electric crush protector and a printing press having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
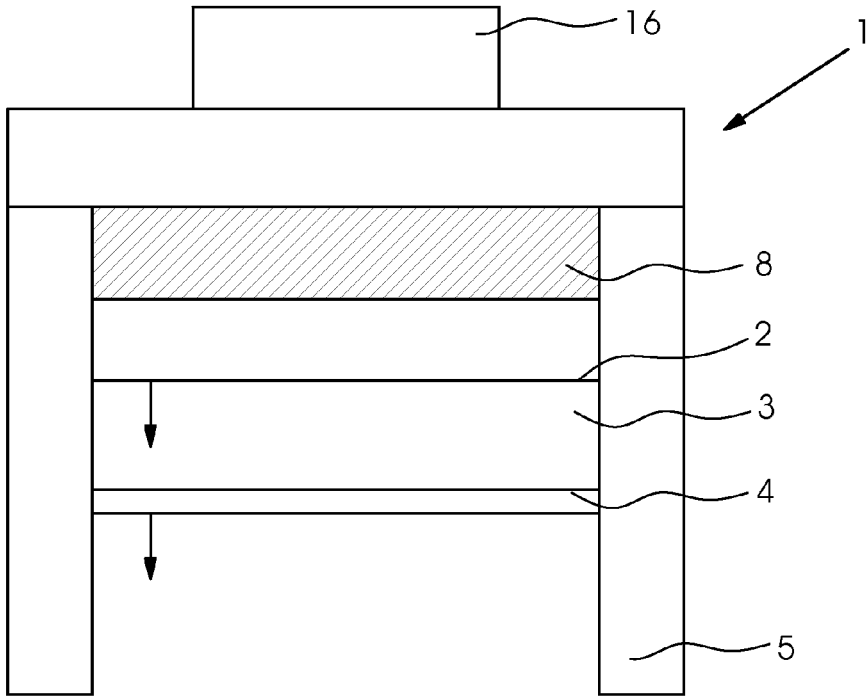
FIG. 1 is a diagrammatic, end-elevational view of a delivery region of a printing press having a movable sample sheet remover.

Referring now to the figures of the drawings in detail and first, particularly, to FIG. 1 thereof, there is seen a delivery 1 of a sheet-fed printing press 16. The delivery 1 adjoins a final printing unit of the sheet-fed printing press 16 and receives finished produced printing materials. The delivery 1 includes a frame with a housing 5 which accommodates a movable stack carrying board 4 and a movable sample sheet remover 2. The sample sheet remover has a flap which, in an open state, permits removal of sheets by a printer. To this end, the sample sheets are not deposited on a main stack like the other sheets, but rather on the sample sheet remover 2. The two components 2, 4 can be displaced vertically parallel to one another. The two components 2, 4 are each driven by a separate respective electric drive motor 6, 7 shown in FIG. 1A. There is therefore no mechanical synchronization between the two components 2, 4. An intermediate space 3 which is either enlarged or reduced or remains constant in parallel operation, as a function of the movement of the two components 2, 4 with respect to one another, is situated between the two movable components 2, 4. It is possible, during the removal of sample sheets, for the hands or head of the operating staff to enter into the region of the intermediate space 3 between a lower edge of the sample sheet removal unit 2 and the main stack carrier or carrying board 4. If this intermediate space 3 is reduced, there is a risk of the operating staff being crushed and injured. It is therefore important that the intermediate space 3 not be reduced, in order to preclude such injuries. A protective cover 8 is situated in an upper region of the sample sheet remover 2. The protective cover 8 protects this region against the actions of the operating staff and moves with the sample sheet remover 2.

Figure 1A:
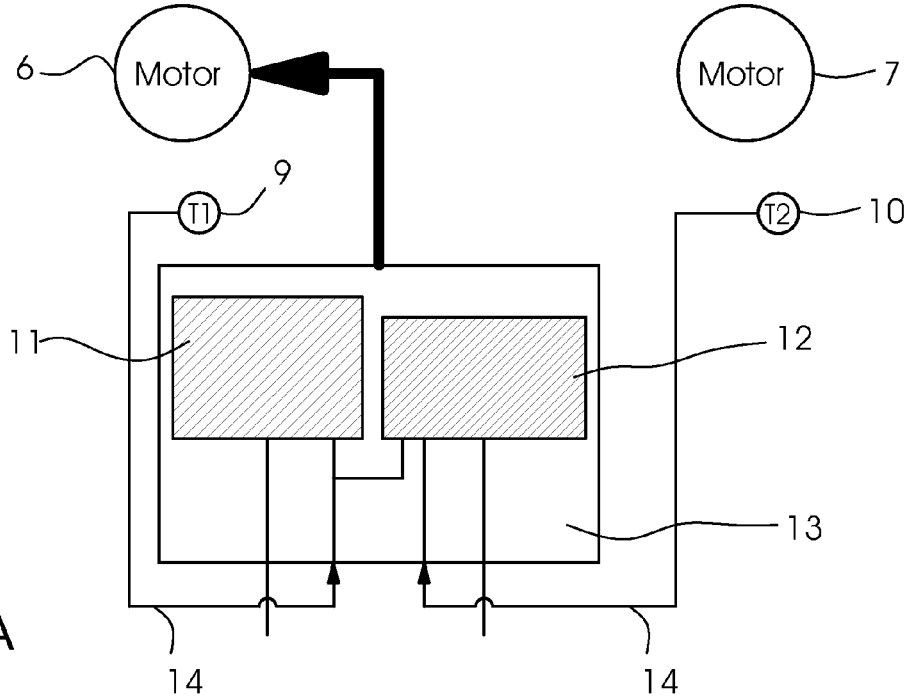
FIG. 1A is a block circuit diagram of a safety controller according to the invention for the delivery of FIG. 1.

FIG. 1A shows a control device according to the invention for the delivery 1 of FIG. 1. The drive motor 6 for the sample sheet remover 2 and the drive motor 7 for the stack carrying board 4 are monitored by a common control computer 13. The control computer 13 calculates corresponding actuating commands for a respective operating state of the delivery 1. The control computer 13 has a redundant construction, with a drive computer 11 actuating the motor 6 in normal operation and a safety computer 12 running in a redundant manner as a monitoring computer. The motor 7 for the stack carrying board 4 is controlled by a similar non-illustrated control computer 13. In the case of malfunctions in the drive computer 11 or in the case of its failure, in each case the safety computer 12 assumes the control of the motor 6 and brings the latter to a standstill if necessary. This avoids a situation in which, if the drive computer 11 fails, an uncontrolled and therefore dangerous operating state of the motors 6, 7 and as a consequence also of the movable components 2, 4 can occur. In order for it to be possible to monitor the spacing in the intermediate space 3, two speed sensors or speed signal generators 9, 10 are moreover connected to the control computer 13 in each case. In this case, the stack carrying board 4 is associated with the speed signal generator 10, while the sample sheet remover 2 is associated with the speed signal generator 9. The speeds of the two stack carrying boards 2, 4 can therefore be detected independently of one another and can be fed to the control computer 13 through communications links 14. The drive computer 11 and the safety computer 12 can compare the speeds of the components 2, 4 which are detected in this way with one another in each case and detect a reduction in the intermediate space 3. As soon as the speed of the sample sheet remover 2 becomes greater than the speed of the stack carrying board 4 in the case of movements of both components in the direction of the arrows in FIG. 1, there is the risk of limbs of the operating staff being crushed in the intermediate space 3 which is becoming smaller. The control computer 13 interprets this positive speed difference between the components 2, 4 as a danger signal and, in the case of a movement in the direction of the arrow in FIG. 1, switches off the drive motor 6 of the sample sheet remover 2. Even if the lower stack carrying board 4 continues to move in the direction of the arrow, there is no longer any risk in this case for the operating staff, since the intermediate space 3 then enlarges again due to the other carrying board 2 which is at a standstill. The crushing risk by the two components 2, 4 is therefore avoided through the use of this actuation by safety technology.

Figure 2:
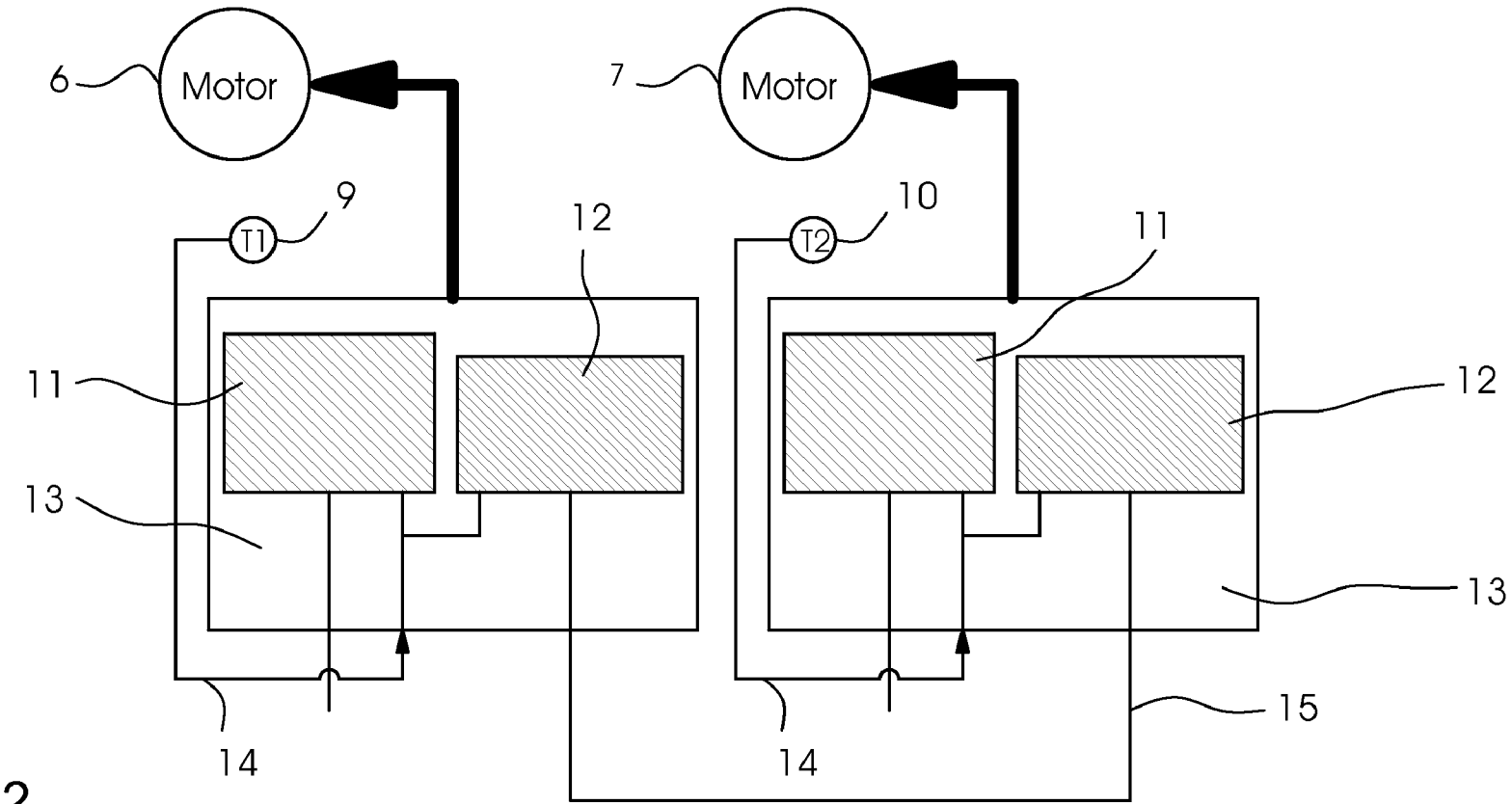
FIG. 2 is a block circuit diagram of a safety controller for the delivery of FIG. 1 with two control computers having a redundant construction.

FIG. 2 shows an alternative refinement of the controller of FIG. 1. In this case, not only are the two drive motors 6, 7 connected in each case to a separate control computer 13, with each of the two control computers 13 having a drive computer 11 and a safety computer 12. In this case, the two speed sensors 9, 10 are also only connected to one control computer 13 in each case, with the result that each of the speed sensors 9, 10 is monitored separately by a control computer 13. The two control computers 13 are connected to one another through a safety bus system 15, through which they can exchange the respective operating states. The exchange of the operating state is carried out in FIG. 2 by the safety computers 12 of the two control computers 13. In contrast, the drive computers 11 are not connected to one another directly. Since each control computer 13 actuates only one drive motor 6, 7 and monitors only one speed signal generator 9, 10, in this case the control computers 13 can have a correspondingly simpler configuration. The safety bus system 15 nevertheless ensures that operating data which are relevant to safety can be exchanged between the safety computers 12.

Figure 3:
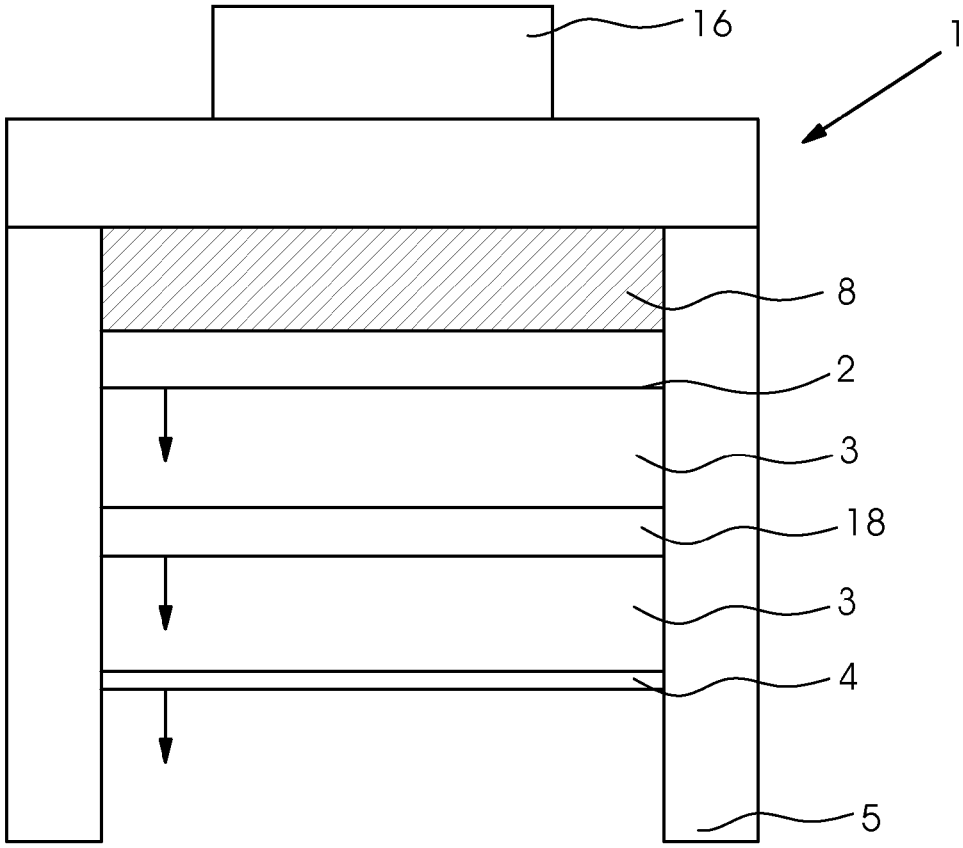
FIG. 3 is an end-elevational view of a delivery having a movable sample sheet remover and a movable auxiliary stack carrying board.

FIG. 3 shows a delivery 1 which has not only a movable sample sheet remover 2 but also a movable auxiliary stack carrier 18. As a consequence, there are three components 2, 4, 18 which can be displaced parallel to one another and have three separate drive motors, and there are two dangerous intermediate spaces 3. In an analogous manner to the exemplary embodiment in FIG. 1, the speeds of all three components 2, 4, 18 are therefore monitored by a control computer 13. As soon as one of the intermediate spaces 3 is reduced during a downward movement, at least the sample sheet remover 2 or the sample sheet remover 2 and the auxiliary stack carrier 18 are switched off, with the result that the intermediate spaces 3 cannot continue to reduce in size. The exemplary embodiment according to FIG. 3 should therefore prevent the sample sheet removal unit 2 from being lowered more quickly than the auxiliary stack device 18 and the auxiliary stack device 18 from being lowered more quickly than the main stack carrying board 4. In this case, upward movements of the main stack carrying board 4 do not have to be taken into consideration, since they can be initiated only by manual operator tasks in the application shown.

Figure 4:
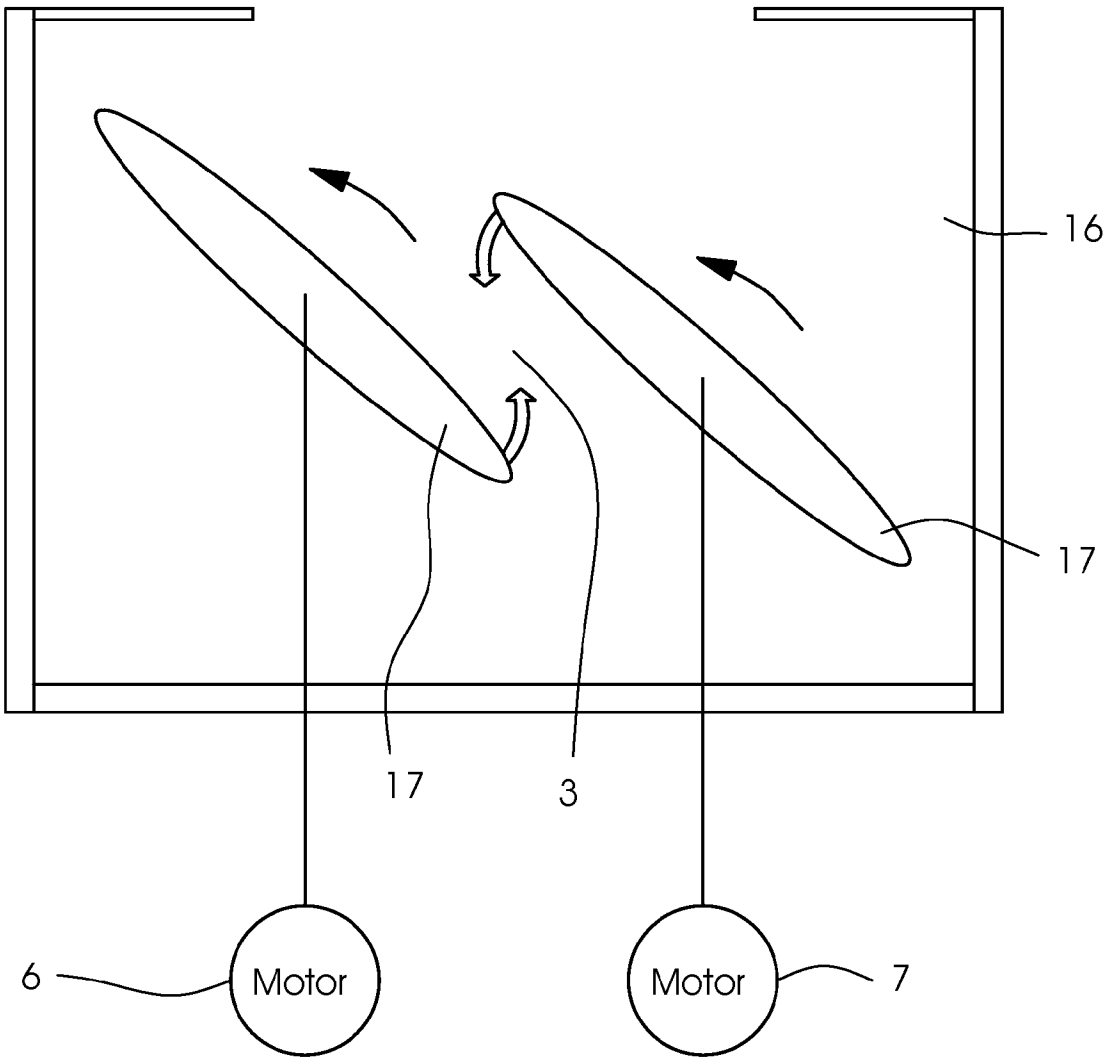
FIG. 4 is a perspective view illustrating the use of the safety apparatus according to the invention in the case of transfer cylinders in a sheet-fed rotary printing press.

In addition to the monitoring of components which can be moved largely in parallel as in the delivery 1, the monitoring of rotationally movable components in a printing press 16 is also possible. FIG. 4 shows transfer cylinders 17 of a sheet-fed printing press 16 by way of example. The two transfer cylinders 17 are each driven by a respectively dedicated drive motor 6, 7, with the result that there is no mechanical coupling between the transfer cylinders 17. In disruption-free operation, the transfer cylinders 17 rotate synchronously and parallel according to the black arrows in a manner which is driven by the motors 6, 7. Therefore, even if the printing press 16 is open, there is no risk of crushing for limbs which pass into the intermediate space 3 between the transfer cylinders 17 in a slow maintenance mode. If, however, this synchronization should become unsynchronized, there is a risk of the intermediate space between the transfer cylinders 17 being reduced according to the white arrows. In this case, there is an acute risk of crushing between the transfer cylinders 17, with the result that a standstill is required. For this purpose, the speeds of the transfer cylinders 17 with respect to one another are detected, so that the control computer 13 can calculate the relative speeds of the transfer cylinders 17 with respect to one another. If the control computer 13 reaches the conclusion from these relative speeds with respect to one another that the intermediate space 3 is being reduced, the transfer cylinders 17 are brought to a standstill.

The invention claimed is:

1. An apparatus for safely operating at least two components movable relative to one another in a machine processing printing materials, the apparatus comprising:

drive motors each driving a respective one of the movable components;

speed signal generators each being associated with a respective one of said drive motors of the movable components for detecting speeds of the movable components; and at least one control computer for detecting movement of the movable components and for comparing the speeds of the movable components detected by said speed signal generators to each other, said at least one control computer connected to said speed signal generators for comparing the speeds of the movable components detected by said speed signal generators, said at least one control computer, upon a reduction in a spacing between the movable components, said reduction being detected by the comparison of the speeds of the movable components to each other, at a time when said drive motors are configured to maintain or increase said spacing between the movable components, bringing to a standstill at least one of the movable components causing said reduction in said spacing between the movable components.

2. The apparatus according to claim 1, wherein the movable components are two components disposed substantially in parallel.

3. The apparatus according to claim 2, wherein the movable components disposed substantially in parallel are disposed in a delivery or feeder of a printing press.

4. The apparatus according to claim 3, wherein one of the movable components is a main stack carrying board and the other of the movable components is a sample sheet removal unit or an auxiliary stack carrier in said delivery.

5. The apparatus according to claim 1, wherein said at least one control computer has a drive computer and a redundant safety computer.

6. The apparatus according to claim 1, wherein said at least one control computer is a plurality of control computers each having a drive computer and a redundant safety computer, said control computers are each associated with a respective one of said drive motors of the movable components, and said control computers communicate with one another over a bus line.

7. The apparatus according to claim 1, wherein said at least one control computer brings all of the movable components to a standstill upon said reduction in said spacing between the movable components.

8. A printing press, comprising the apparatus according to claim 1.

* * * * *